US012059630B1

(12) United States Patent
Kaplan et al.

(10) Patent No.: US 12,059,630 B1
(45) Date of Patent: Aug. 13, 2024

(54) THERAPEUTIC GAME FOR STROKE SURVIVORS IMPROVING FINE AND GROSS MOTOR SKILL

(71) Applicant: AlonTree Company, Candler, NC (US)

(72) Inventors: Alon Kaplan, Asheville, NC (US); Christine Perrone, Leicester, NC (US)

(73) Assignee: AlonTree Company

( * ) Notice: Subject to any disclaimer, the term of this patent is extended or adjusted under 35 U.S.C. 154(b) by 0 days.

(21) Appl. No.: 18/533,279

(22) Filed: Dec. 8, 2023

(51) Int. Cl.
*A63F 9/02* (2006.01)
*A63F 9/00* (2006.01)
*A63F 11/00* (2006.01)

(52) U.S. Cl.
CPC ..... *A63F 9/0204* (2013.01); *A63F 9/0278* (2013.01); *A63F 2009/0007* (2013.01); *A63F 2011/0062* (2013.01); *A63F 2011/0067* (2013.01); *A63F 2250/609* (2013.01)

(58) Field of Classification Search
CPC ..... A63F 9/0204; A63F 9/0278; A63F 2009/0007; A63F 2011/0062; A63F 2011/0067; A63F 2250/609
See application file for complete search history.

(56) References Cited

U.S. PATENT DOCUMENTS 636,663 A * 11/1899 Harrison ..... A63F 3/00895 273/284
1,616,270 A * 2/1927 Madden ..... A63F 9/0204 273/342
3,721,440 A 3/1973 Burns
3,913,916 A 10/1975 Martin
5,292,276 A 3/1994 Manalo
5,772,446 A 3/1998 Zheng
6,398,222 B1 6/2002 Everett
6,402,153 B1 6/2002 Stewart
6,715,826 B2 4/2004 Bellows et al.
7,448,969 B2 11/2008 Weber et al.
7,857,624 B2 12/2010 Davis et al.
8,337,337 B2 12/2012 Lay
8,408,513 B2 4/2013 Smith
8,651,492 B1 * 2/2014 Cappuccio ..... A63B 71/0036 273/398
9,028,258 B2 5/2015 Burdea
9,199,149 B2 * 12/2015 Max ..... A63B 63/08
(Continued)

OTHER PUBLICATIONS

Educational Ball Drop Toy for Kids, [online] [retrieved Nov. 20, 2023]. Retrieved from the internet <URL:https://www.amazon.com/WEofferwhatYOUwant-Educational-Ball-Drop-Kids/dp/B0129RFLDW>.

(Continued)

*Primary Examiner* — Michael D Dennis
(74) *Attorney, Agent, or Firm* — Clements Bernard Walker; Jennifer R. Knight

(57) ABSTRACT

The present invention provides a therapeutic game for holistically engaging people who have had a stroke or other brain injury in gross and fine motor skill activities. The therapeutic game is a self-contained set of objects that can be placed on or in a set of targets. Targets can be openings within a container in which to drop or toss the objects. A target can be a daisy support with a base, stem, and receptacle removably attachable to the stem on which or in which an object can be placed. A scoring system can also be used mark progress and to engage the mental powers as well as the physical powers.

18 Claims, 13 Drawing Sheets

(56) References Cited

U.S. PATENT DOCUMENTS

| | | | | |
|---|---|---|---|---|
| 9,724,598 | B2 | 8/2017 | Burdea | |
| 9,739,576 | B1 * | 8/2017 | Venigalla | A63F 13/60 |
| 9,770,637 | B2 | 9/2017 | Cranford | |
| 9,808,572 | B2 | 11/2017 | Kamen et al. | |
| 10,299,738 | B2 | 5/2019 | Raghavan et al. | |
| 10,542,639 | B2 | 1/2020 | Yamamoto | |
| 10,786,652 | B2 | 9/2020 | Doshi et al. | |
| 2010/0275458 | A1 | 11/2010 | Saunders | |
| 2015/0125838 | A1 | 5/2015 | Pack | |
| 2017/0144058 | A1 | 5/2017 | Wright | |
| 2018/0028887 | A1 | 2/2018 | Hofmann et al. | |

OTHER PUBLICATIONS

Putting Things Away and Into Containers, [online] [retrieved Nov. 20, 2023]. Retrieved from the internet <URL:https://www.adam-mila.com/milestones/fine-motor-skills/put-in-take-out/>.

* cited by examiner

THERAPEUTIC GAME FOR STROKE SURVIVORS IMPROVING FINE AND GROSS MOTOR SKILL

TECHNICAL FIELD

The invention relates to tools and methods for use in rehabilitating, both occupational therapy and physical therapy, a person who has suffered a stroke or other traumatic brain injury. The invention integrates several occupational and physical therapy exercises into a fun game that is designed to be playable independently by a stroke survivor.

BACKGROUND

Stroke is a common neurological condition that affects a significant number of individuals worldwide. Stroke can result in long-term disability, with loss of fine and gross motor skills being a common issue in survivors. Currently, many recovery approaches for stroke survivors require a culture of dependence that impacts both the survivor and their caregiver. Hence, there is an unmet need for stroke recovery equipment that focuses on utilizing neuroplasticity, improving fine and gross motor skills, and providing an enjoyable approach to recovery.

Many stroke survivors work with both occupational and physical therapists to regain function and to improve the quality of their lives. Much of the rehabilitation utilizes neuroplasticity, thus improving the brain's ability to change in structure or function in response to experience. This implies that the healthy brain tissue can be trained to perform the functions previously controlled by damaged brain cells, ultimately helping stroke survivors become whole again. Also, in the context of stroke recovery and rehabilitation, proprioception (coordination and ability to sense one's own body) and kinesthesia (the ability to sense motion in a joint or limb) play crucial roles in regaining motor skills and increasing mobility. There is a need for a therapeutic game designed with these principles in mind, utilizing techniques to improve proprioceptive feedback and enhance the user's sense of body position and movement.

There is a need to reduce the culture of dependence on caregivers that currently exists in stroke recovery approaches. There is a need for a therapeutic game based on a fun-filled approach that changes the mindset of the player from viewing recovery as a boring exercise to an exciting gameplay experience. There is a need for therapeutic game for stroke survivors that utilizes a combination of neuroplasticity and a fun-filled approach to improve the fine and gross motor skills of stroke survivors while also reducing the culture of dependence on caregivers. There is a need for a therapeutic game that can be played independently, making it a time-efficient approach to recovery.

There is a need for an accessible and affordable therapeutic game for stroke survivors. There is a need for a therapeutic game that can be played in variety of settings, including at home, in the community, or in a clinical setting. There is a need for an affordable and accessible therapeutic game for those who may not have access to expensive medical equipment or therapies. By employing game-like elements in our invention, we hope to encourage stroke survivors to stay committed to their recovery journey and engage in activities that improve their proprioceptive sense and overall motor function.

SUMMARY

According to an embodiment of the present invention, a therapeutic game is provided. The therapeutic game comprises a) a container with a closable lid; b) at least two target openings near the top of the container; and c) at least two objects. Each of the at least two objects can pass through at least one of the at least two target openings.

According to another embodiment of the present invention, a therapeutic game is provided. The therapeutic game comprises a) a container with a closable lid; b) at least two objects; and c) a daisy support. The daisy support comprises i) a base; ii) a stem attachable to the base; and iii) at least one receptacle removably attachable to the stem distal from the base. The stem is attachable to the base either permanently or removably. The at least one receptacle comprises: a) an attachment section capable of overlapping with the distal end of the stem when the at least one receptacle is removably attached to the stem; b) a transition section connected to the attachment section, wherein the transition section is not capable of overlapping with the distal end of the stem when the at least one receptacle is removably attached to the stem; and c) an object-holding section attached to the transition section on a side opposite to the attachment section. The at least one receptacle is capable of intermittently holding up at least one of the at least two objects placed on or in the object-holding section. The at least one receptacle comprises an adjustable receptacle, wherein the object-holding section is adjustable, and the adjustable object-holding section comprises: i) at least three flexible rods fixedly attached to the distal side of the transition section; and ii) an adjustment section slidably attached to the at least three flexible rods. The adjustable object-holding section comprises an effective opening among the flexible rods, and the size of the effective opening is adjustable from larger to smaller by moving the adjustment section further away from the transition section.

According to yet another embodiment of the present invention, a therapeutic game is provided. The therapeutic game comprises a) a container with a closable lid; b) two to four target openings near the top of the container; and c) 2 to 200 objects; d) a score-keeping set of colorful droplets and cards; e) a daisy support, and f) at least one additional receptacle removable attachable to the stem distal from the base. The daisy support comprises i) a base; ii) a stem attachable to the base; and iii) an adjustable receptacle removable attachable to the stem distal from the base. Each of the adjustable receptacle and the at least one additional receptacle comprises a) an attachment section capable of overlapping with the distal end of the stem when the adjustable receptacle or the at least one additional receptacle is removably attached to the stem; b) a transition section connected to the attachment section, wherein the transition section is not capable of overlapping with the distal end of the stem when the adjustable receptacle or the at least one additional receptacle is removably attached to the stem; and c) an object-holding section attached to the transition section on a side opposite to the attachment section. Each of the adjustable receptacle and the at least one additional receptacle is capable of intermittently holding up at least one of the objects placed on or in the object-holding section. The adjustable receptacle object-holding section comprises i) at least three flexible rods fixedly attached to the distal side of the transition section; and ii) an adjustment section slidably attached to the at least three flexible rods. The adjustable object-holding section comprises an effective opening among the flexible rods, and the size of the effective opening is adjustable from larger to smaller by moving the adjustment section further away from the transition section. Each of the objects can pass through at least one of the two to four target openings.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION

Figure 1:
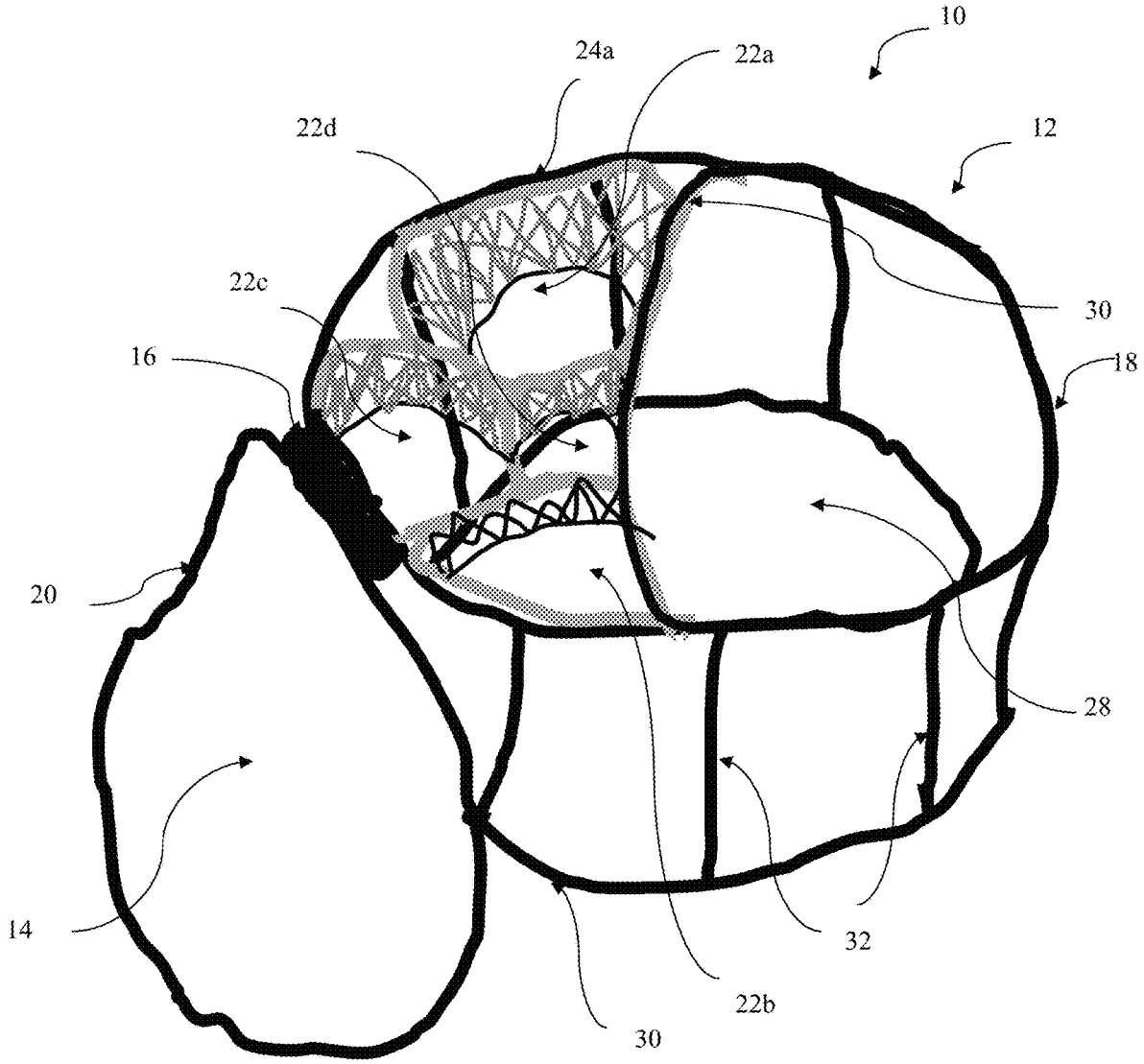
FIG. 1 is a schematic of a perspective view of a non-limiting embodiment of the therapeutic game container showing four target openings and one auxiliary opening.

According to an embodiment of the present invention, a therapeutic game is provided. The therapeutic game comprises a) a container with a closable lid; b) at least two target openings near the top of the container; and c) at least two objects. Each of the at least two objects can pass through at least one of the at least two target openings.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

It is to be understood that the mention of one or more method steps does not preclude the presence of additional method steps before or after the combined recited steps or intervening method steps between those steps expressly identified. Moreover, the lettering of method steps or ingredients is a conventional means for identifying discrete activities or ingredients and the recited lettering can be arranged in any sequence, unless otherwise indicated.

As used herein, the term "and/or", when used in a list of two or more items, means that any one of the listed items can be employed by itself, or any combination of two or more of the listed items can be employed. For example, if a set is described as containing articles A, B, "and/or" C, the set may contain A alone; B alone; C alone; A and B in combination; A and C in combination; B and C in combination; or A, B, and C in combination.

As used herein, the term "target opening" refers to a defined area within the container into which a player tries to place an object.

As used herein, the term "objects" refers to the pieces of the game that a player would attempt to place into target openings and/or on the daisy support, specifically placing the pieces in or on the receptacle. "Objects" can be different in shape, size, weight, and texture to give the player the experience of picking up a variety of items.

As used herein, the term "adjustable receptacle" refers to a receptacle capable of varying the size of the object-holding section of the "adjustable receptacle" capable of intermittently holding up an object. As used herein, the term "one-directional receptacle", refers to a receptacle with only one section capable of being removably attached to the stem. As used herein, the term "reversable receptacle" refers to a receptacle capable of being removably attached to the stem in a first direction and can also be removably attached to the stem in a second direction, after being turned 180 degrees from the first direction, and is capable of intermittently holding up an object when placed in both the first direction and the second direction.

In some aspects, the therapeutic game comprises a) a container with a closable lid; b) at least two target openings near the top of the container; c) at least two objects; and d) a score-keeping set of colorful droplets and cards. In some aspects, the at least two target openings consist of two to four hoops, wherein each of the hoops is different in size. In some aspects that therapeutic game comprises 2 to 200, or 1 to 150, or 2 to 100, or 2 to 50, or 5 to 200, or 5 to 150, or 5 to 100, or 5 to 50, or 10 to 200, or 10 to 150, or 10 to 100, or 10 to 50 objects. In some aspects the objects comprise poker chips, small balls, tennis balls, racquet balls, dice, golf tees, playing cards, index cards, stoppers, and/or coasters.

In some aspects, each of the at least two target openings has a different color marking and/or a different number marking. In some aspects, the score-keeping set of colorful droplets and cards comprises a set of colorful droplets (i.e., small beads) corresponding to each of the at least two target openings and a colored card corresponding to each set of the colorful droplets. In some aspects each set of colorful droplets comprises 2 to 100 droplets. In some aspects each of the colored cards has a different number. In some aspects, the container comprises four target openings, each opening is a different size, and the openings are labeled according to size from 1 to 4 with 1 being the largest target opening and 4 being the smallest target opening. In some aspects, the score-keeping set of colorful droplets and cards further comprises a set of mistake droplets and mistake cards, wherein each of the mistake cards is marked with a type of mistake.

In some aspects, the therapeutic game further comprises a daisy support. The daisy support comprises a base, a stem attachable to the base, and at least one receptacle removably attachable to the stem distal from the base. The at least one receptacle is capable of intermittently holding up at least one of the at least two objects. In some aspects, the stem is permanently attachable to the base. In some aspects, the stem is removably attachable to the base.

In some aspects, the at least one receptable comprises a) an attachment section capable of overlapping with the distal end of the stem when the at least one receptacle is removably attached to the stem, b) a transition section connected to the attachment section, wherein the transition section is not capable of overlapping with the distal end of the stem when the at least one receptacle is removably attached to the stem, and c) an object holding section attached to the transition section on a side opposite to the attachment section. The at least one receptacle is capable of intermittently holding up at least one of the at least two objects placed on or in the object-holding section.

In some aspects, the at least one receptacle is independently selected from the group consisting of adjustable receptacles, one-directional receptacles, or reversible receptacles. In some aspects, the at least one receptacle is an adjustable receptacle, wherein the object-holding section comprises at least three flexible rods fixedly attached to the distal side of the transition section, and an adjustment section slidably attached to the at least three flexible rods. The object holding section comprises an effective opening among the flexible rods, and a size of the effective opening is adjustable from larger to smaller by moving the adjustment section further away from the transition section. In some aspects, the at least one receptable is an adjustable receptacle, wherein the object-holding sections comprises a base and two sides, at least one of the two sides is movable, and the size of the object-holding section is varied by moving at least one of the two sides.

In some aspects, the at least one receptacle comprises the one-directional receptacle or the reversible receptacle. In some aspects, the object-holding section comprises a bowl, an open-top cylinder, at least three separated pieces, a three-dimensional X with a raised section at an end of each line of the X distal to the transition section, or a three dimensional X with a curved shape of each line of the X distal to the transition section. In some aspects, the object-holding section is the open-top cylinder having at least one pair of vertical slits starting at the top of the cylinder and located 180 degrees apart on a circumference of the cylinder. In some aspects, each pair of slits is capable of holding up an index card.

According to another embodiment of the present invention, a therapeutic game is provided. The therapeutic game comprises a) a container with a closable lid; b) at least two objects; and c) a daisy support. The daisy support comprises i) a base; ii) a stem attachable to the base; and iii) at least one receptacle removably attachable to the stem distal from the base. The stem is attachable to the base either permanently or removably. The at least one receptacle comprises: a) an attachment section capable of overlapping with the distal end of the stem when the at least one receptacle is removably attached to the stem; b) a transition section connected to the attachment section, wherein the transition section is not capable of overlapping with the distal end of the stem when the at least one receptacle is removably attached to the stem; and c) an object-holding section attached to the transition section on a side opposite to the attachment section. The at least one receptacle is capable of intermittently holding up at least one of the at least two objects placed on or in the object-holding section. The at least one receptacle comprises an adjustable receptacle, wherein the object-holding section is adjustable, and the adjustable object-holding section comprises: i) at least three flexible rods fixedly attached to the distal side of the transition section; and ii) an adjustment section slidably attached to the at least three flexible rods. The adjustable object-holding section comprises an effective opening among the flexible rods, and the size of the effective opening is adjustable from larger to smaller by moving the adjustment section further away from the transition section.

In some aspects, the therapeutic game comprises a) a container with a closable lid; b) at least two objects; c) a daisy support; d) at least two target openings near the top of the container; and e) a score-keeping set of colorful droplets and cards. In some aspects, each of the at least two objects can pass through at least one of the at least two target openings.

In some aspects, the at least two target openings consist of two to four hoops, and each of the hoops is different in size. In some aspects, the at least two objects comprise 2 to 200 objects. In some aspects, the objects comprise poker chips, small balls, tennis balls, racquet balls, dice, golf tees, playing cards, index cards, stoppers, and/or coasters.

In some aspects, the therapeutic game further comprises at least one additional receptacle comprises at least two receptacles. In some aspects, the at least two receptacles comprise the adjustable receptacle and at least one additional receptacle.

In some aspects, the at least one additional receptacle comprises a one-directional receptacle or a reversible receptacle. In some aspects, the object-holding section comprises a bowl, an open-top cylinder, at least three separated pieces, a three-dimensional X with a raised section at an end of each line of the X distal to the transition section, or a three dimensional X with a curved shape of each line of the X distal to the transition section.

In some aspects, the object-holding section is the open-top cylinder having at least one pair of vertical slits starting at the top of the cylinder and located 180 degrees apart on the circumference. In some aspects, each pair of slits is capable of holding up an index card.

In some aspects, the at least one additional receptacle is the reversible receptacle. In some aspects, the object-holding section is at least three separated pieces, a three-dimensional X with a raised section at an end of each line of the X distal to the transition section, or a three dimensional X with a curved shape of each line of the X distal to the transition section. In some aspects, when the reversible receptacle is placed up-side-down on the stem, the three separated pieces or any of the three dimensional X's fit within the stem when the receptacle is removably attached to the stem.

According to yet another embodiment of the present invention, a therapeutic game is provided. The therapeutic game comprises a) a container with a closable lid; b) two to four target openings near the top of the container; and c) 2 to 200 objects; d) a score-keeping set of colorful droplets and cards; e) a daisy support, and f) at least one additional receptacle removable attachable to the stem distal from the base. The daisy support comprises i) a base; ii) a stem attachable to the base; and iii) an adjustable receptacle removable attachable to the stem distal from the base. Each of the adjustable receptacle and the at least one additional receptacle comprises a) an attachment section capable of overlapping with the distal end of the stem when the adjustable receptacle or the at least one additional receptacle is removably attached to the stem; b) a transition section connected to the attachment section, wherein the transition section is not capable of overlapping with the distal end of the stem when the adjustable receptacle or the at least one additional receptacle is removably attached to the stem; and c) an object-holding section attached to the transition section on a side opposite to the attachment section. Each of the adjustable receptacle and the at least one additional receptacle is capable of intermittently holding up at least one of the objects placed on or in the object-holding section. The adjustable receptacle object-holding section comprises i) at least three flexible rods fixedly attached to the distal side of the transition section; and ii) an adjustment section slidably attached to the at least three flexible rods. The adjustable object-holding section comprises an effective opening among the flexible rods, and the size of the effective opening is adjustable from larger to smaller by moving the adjustment section further away from the transition section. Each of the objects can pass through at least one of the two to four target openings.

FIG. 1 shows a schematic of a non-limiting container 10 of the therapeutic game. The container 10 has a base 12 and closable lid 14. An attachment portion 16 of the lid 14 is permanently attached to the base 12 near the base top circumference 18. The lid 14 is closable at the lid circumference 20 and the base top circumference 18 via a zipper (not shown). In FIG. 1, the base 12 is shown with four differently sized target openings 22*a*, 22*b*, 22*c*, and 22*d*. In FIG. 1, each target opening 22*a*-22*d* is formed by a rim (e.g., 24*a*) and a small amount of mesh (e.g., 26*a*) permanently attached to and hanging down from the rim (e.g., 24*a*). A larger, auxiliary opening 28 encompasses the remaining portion of the base 12 and is defined by a rim 30 that is attached to part of the base circumference distal from the target openings 22*a*-22*d* and attaches to part of the rims of target opening 22*a*, 22*d*, and 22*b*. Target openings 22*a*, 22*c*, 22*b*, and auxiliary opening 28 are arranged counter-clockwise. The rim of target opening 22*d* is attached to the rim of each of the other target openings 22*a*-22*c* and the rim of storage opening 28. Target opening 22*d* is the only opening that is not attached the base top circumference 18. The auxiliary opening 28 serves both as an area to allow objects (not shown) that do not successfully go through one of the target openings 22*a*-22*d* to remain in the container 12 (as opposed to falling to the floor) and as the opening 28 through which the therapeutic game components (not shown) such as, for example, the objects, the score keeping colorful droplets, and cards can be placed into the container 12 for storage. In some embodiments, target openings 22*a*-22*d* are color coded and/or numbered from 1 to 4, where the numbers 1-4 represent points a player scores when getting an object (no shown) into each of the target openings (i.e., an object through target opening 22*a* may be worth 1 point, an object through target opening 22*b* may be worth 2 points, an object through target opening 22*c* may be worth 3 points, an object through target opening 22*d* may be worth 4 points). The higher the number of points corresponding to the smaller the target opening 22*a*-22*d*.

As noted above, the container 10 is designed to be used both as a game component while playing the therapeutic game and as a receptacle while transporting or storing the therapeutic game. The height of the container 10 and the size of the auxiliary opening 28 are selected to ensures that all of the therapeutic game components can be placed into the base 12 through auxiliary opening 28. In some embodiments container 10 further has a shoulder strap (not shown) attached to the outside of the base 12 at opposite sides of base 12 near the base top circumference 18.

In some embodiments, container 10 is made mostly of a sturdy fabric. Base 12 stands upright through the support of a semiflexible rim near the base bottom circumference 30 and multiple vertical semi-flexible support pieces 32 attached to the base bottom circumference 30 on the bottom end and to the rims of the target openings 22*a*-22*c*, e.g., rim 24*a* and auxiliary opening 28 at rim 30 on the top circumference 18.

Figure 2A:
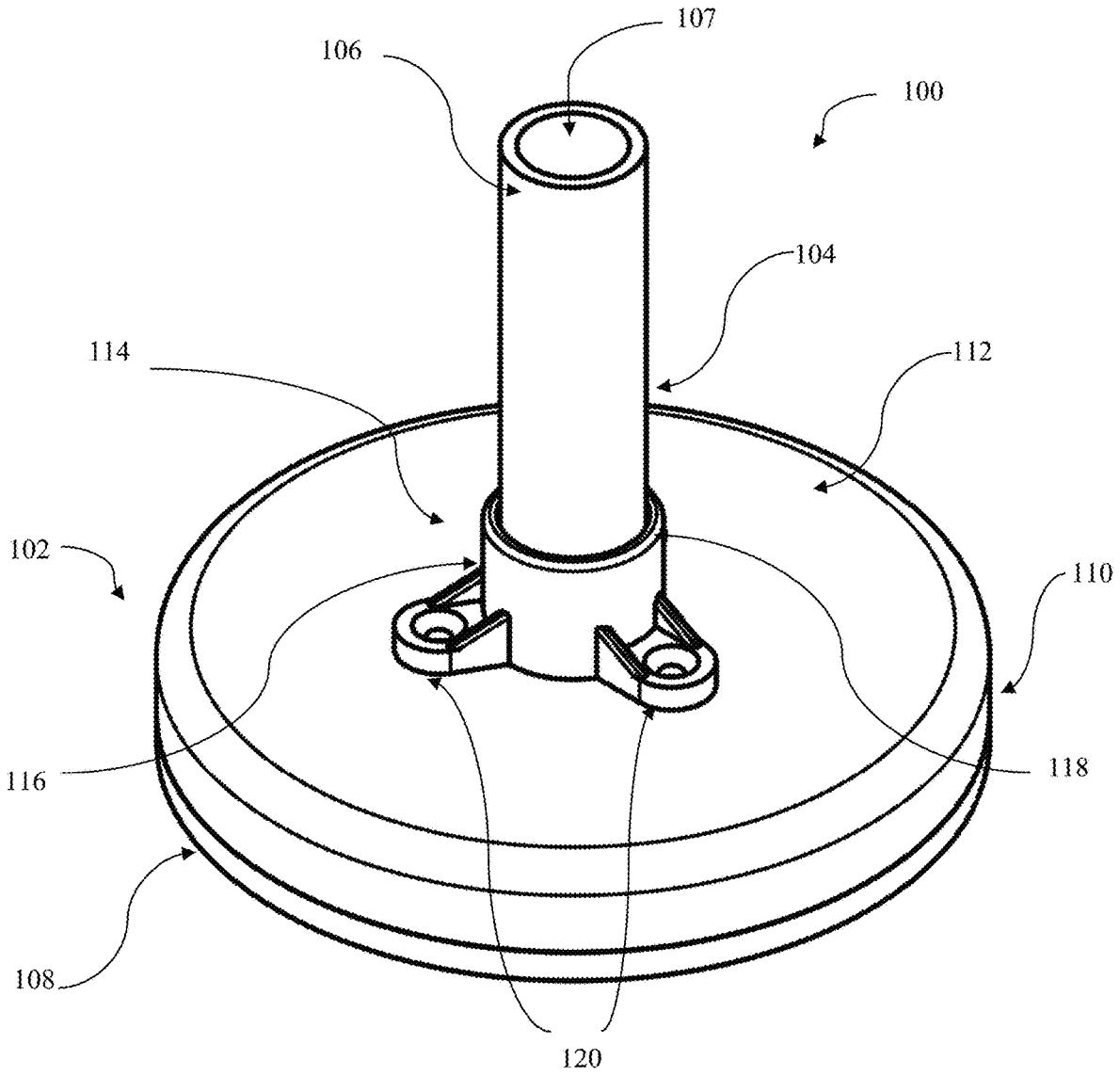
FIG. 2*a* is a schematic of a perspective view of a non-limiting embodiment of the daisy support, showing the base and the stem which is capable of supporting a receptacle (not shown)
Figure 2B:
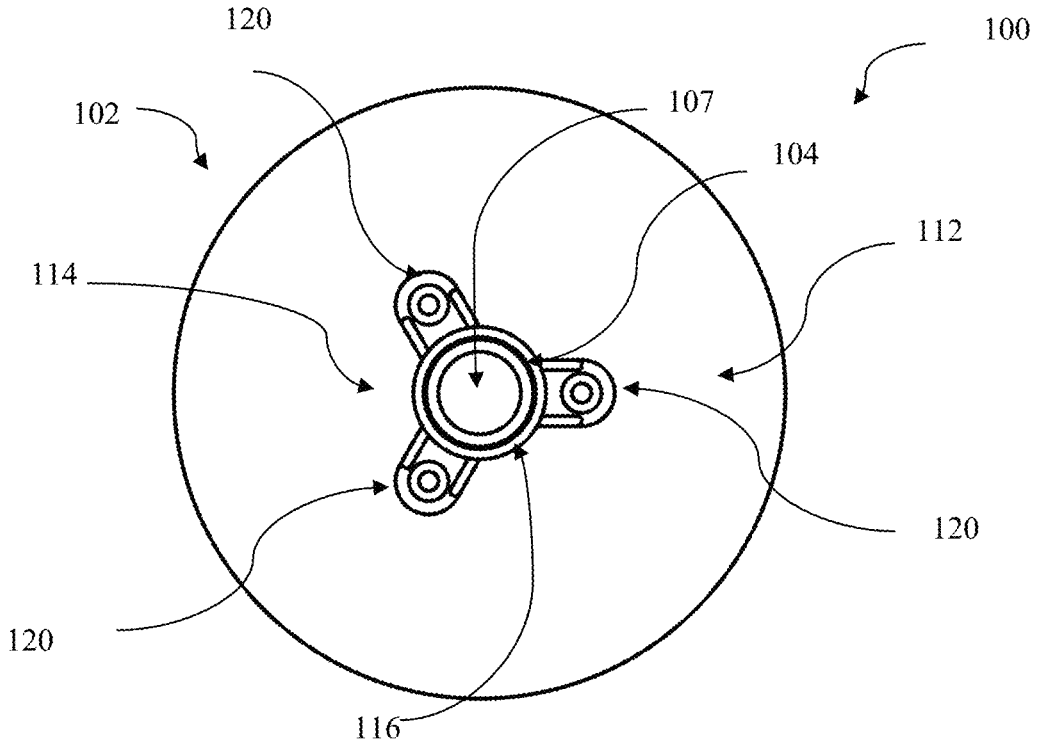
FIG. 2*b* is a schematic of a top view of the daisy support shown in FIG. 2*a;*
Figure 2C:
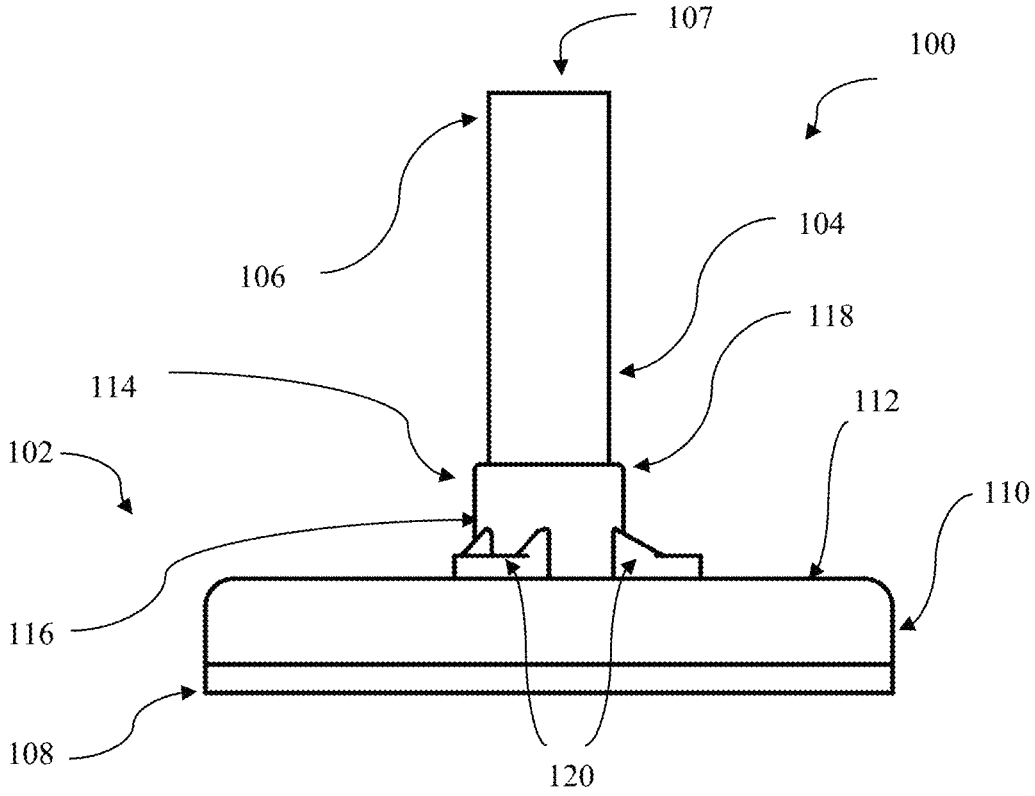
FIG. 2*c* is a schematic of a side view of the daisy support shown in FIG. 2*a;*

A daisy support comprises a base, a stem removably attachable to the base, and a receptacle removably attachable to the stem distal from the base. The receptacle is capable of intermittently holding up at least one object. FIG. 2*a* is a schematic of a perspective view of a non-limiting embodiment of a daisy support 100 with a base 102 and a stem 104 removably attachable to the base 102, and a receptacle (not shown) that is removably attachable to the stem top 106. Various receptacles that are removably attachable to the stem 104 at the stem top 106 are shown in FIGS. 3-8. Receptacles can be removably attached to the stem top 106 by being inserted into stem opening 107 or by enveloping the outside of the stem top 106. Referring to FIGS. 2*a*-2*c*, the base 102 is designed for stably holding up the stem 104 and the receptacle when a player is placing objects (not shown) onto or removing objects off of a receptacle. As such, the base 102 has a bottom layer 108 which can provide resistance to the daisy support 100 moving when the stem 104 and/or the receptacle are impacted by a player or an object. The base 102 has a thickness which can have decorative features 110 and has a flat top 112. A stem holder 114 is located near the center of the base top 112 for removable attaching the stem 104 to the base 102. The stem holder 114 has a cylinder 116 with the bottom attached to the base top 110 and the cylinder top 118 has an opening 120 to receive the removably attachable stem 104. Attached to the cylinder 114 are three extensions 122 which are capable of receiving screws to attach the stem holder 114 to the base top 110.

Figure 3A:
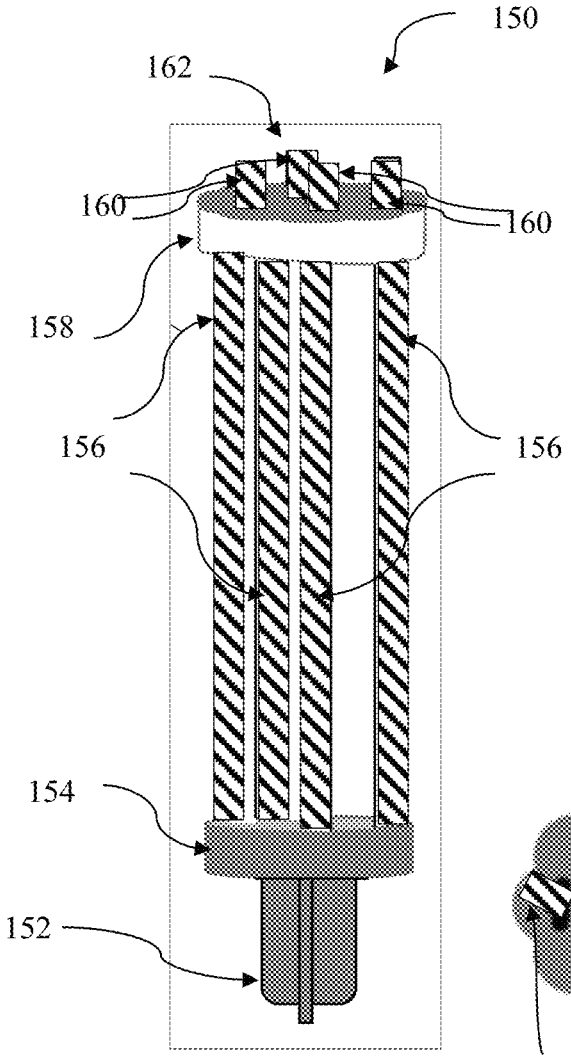
FIGS. 3*a* and 3*b* are schematics of perspective and top views of a non-limiting embodiment of an adjustable receptacle capable of being removably attached to the stem of the daisy support (not shown) and in the fully-closed position.
Figure 3B:
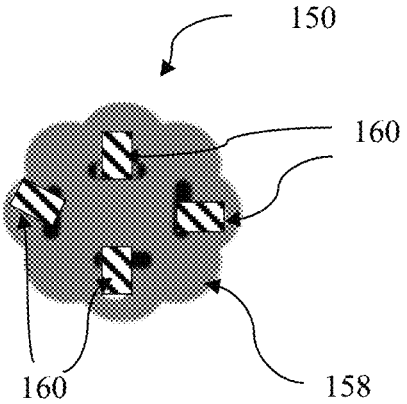
Figure 3C:
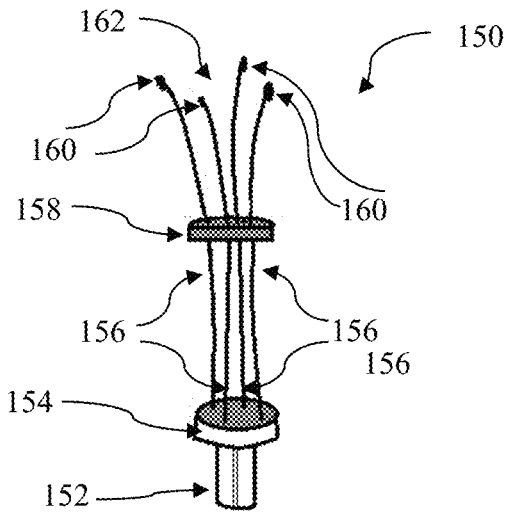
FIGS. 3*c* and 3*d* are schematics of side and top views of the adjustable receptacle shown in FIGS. 3*a* and 3*b* in the half-opened position.
Figure 3D:
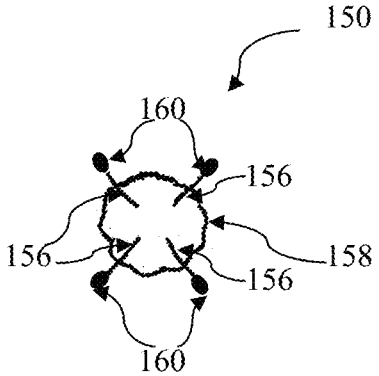
Figure 3E:
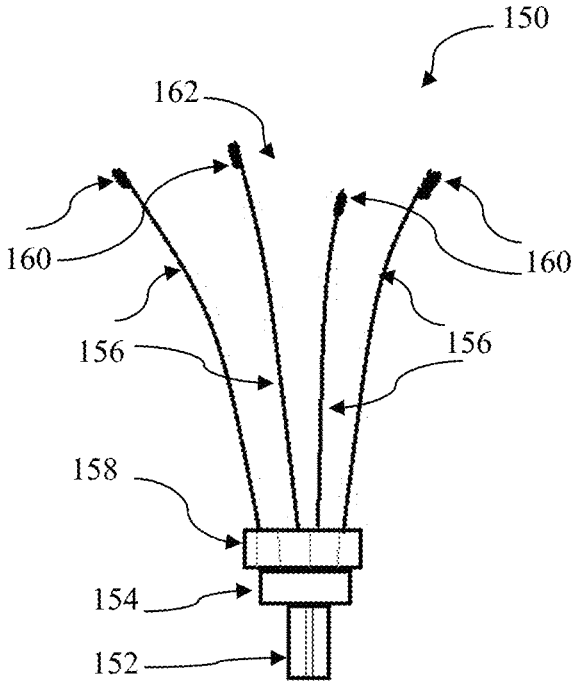
FIGS. 3*e* and 3*f* are schematics of perspective and top views of the adjustable receptacle shown in FIGS. 3*a* and 3*b* in the fully-opened position.
Figure 3F:
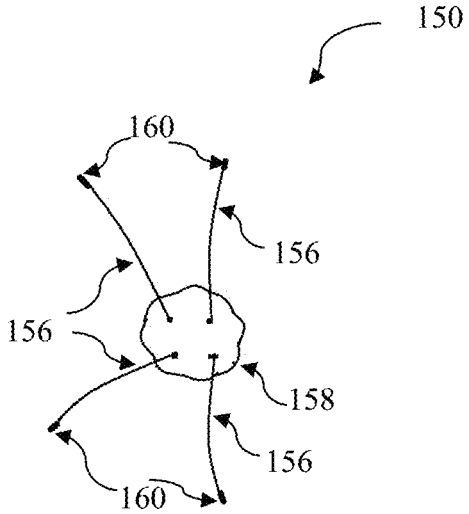
Figure 4A:
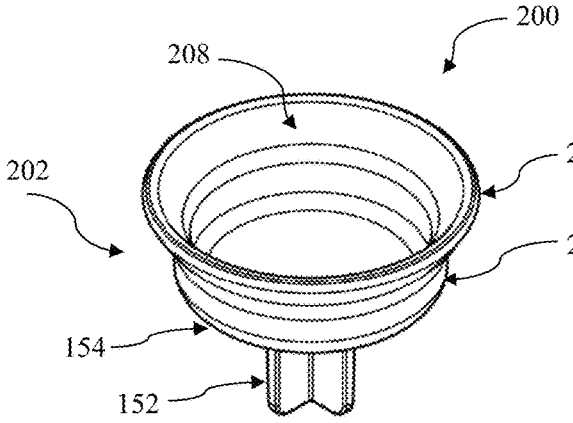
FIG. 4*a* is a schematic of a perspective view of a non-limiting example of a receptacle capable of being removably attached to the stem of the daisy support (not shown)
Figure 4B:
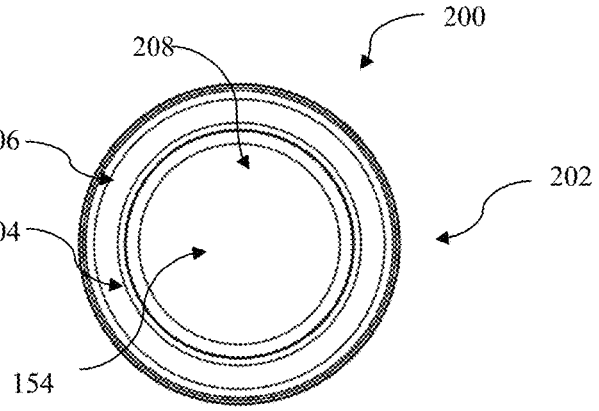
FIG. 4*b* is a schematic of a top view of the receptacle shown in FIG. 4*a;*
Figure 4C:
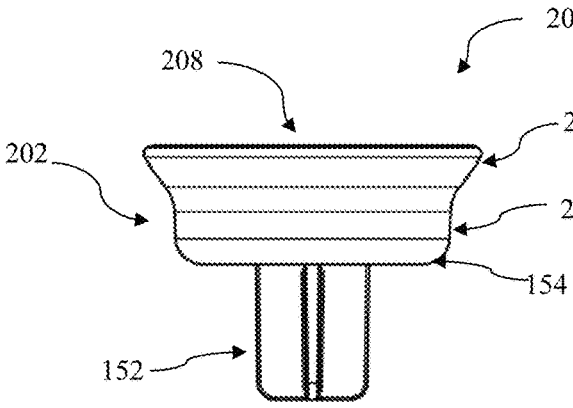
FIG. 4*c* is schematic of a side view of the receptacle shown in FIG. 4*a;*
Figure 4D:
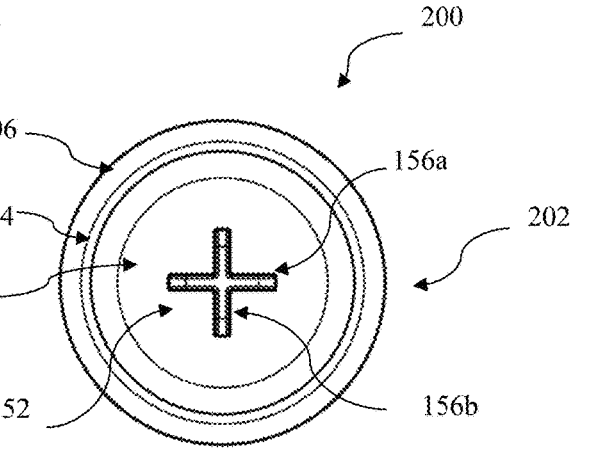
FIG. 4*d* is a schematic of a bottom view of the receptacle shown in FIG. 4*a;*

FIGS. 3*a*, 3*c*, and 3*e* are schematics of a non-limiting embodiment of an adjustable receptacle 150, with the adjustable receptacle 150 shown in the fully-closed position, half-opened position, and fully-opened position, respectively. Considering FIGS. 2*a*-2*c* and FIGS. 3*a*-*d*3*f*, the adjustable receptacle 150 has an attachment section 152 capable of overlapping with the distal end of the stem, the stem top 106, when the adjustable receptacle 150 is removably attached to the stem 104 by inserting the attachment section 152 into the stem opening 107. The transition section 154 is connected to the attachment section 152 and is not capable of overlapping with the stem top 106 when the adjustable receptacle 150 is removably attached to the stem 104. The adjustable receptacle 150 has four flexible rods 156 fixedly attached to the transition section 154 distal to the attachment section 152. The adjustment section 158 is slidably attached to the four flexible rods 156. The four flexible rods 156 have thicker tops 160 to ensure that the adjustable section 158 remains slidably attached to the four flexible rods 156. The four flexible rods 156 are evenly dispersed around the transition section 154 and flare outward as the adjustable section 158 moves from its most distant location from the transition section 154 to being adjacent to the transitions section 154. The object holding section 162 is defined by the space between the four flexible rods 156. For example, when the adjustable receptacle is in the fully-closed as in FIGS. 3*a* and 3*b*, a small enough ball (not shown) can be placed directly on the top of the adjustable section 158, constrained in movement by the thicker tops 160 of the four flexible rods 156, and a larger ball can be placed directly on the thicker tops 160 of the four flexible rods 156. As the adjustable section 158 moves downward, toward the transition section 154, the object holding section 162 gets bigger and more forgiving. As the object holding section 162 expands, there is more room for error in placing a ball into the holding section 162. Also, the holding section 162 is more forgiving if you are removing a ball from the holding section 162 (in other words, a ball is less easily knocked off the adjustable receptacle 150 as a player is attempting get her hand around the ball to remove it from the holding section 162).

FIGS. 4*a*-4*d* are perspective, top, side, and bottom views, respectively, of a non-limiting embodiment of a receptacle 200. The receptacle has an attachment section 152, a transition section 154 and an object holding section 202. Object holding section 202 is a bowl which includes the cylinder 204 with a flared top 206, and the transition section 154 distal to the attachment section 152. The object holding section 202 has top opening 208 through which objects (not shown) can be placed in receptacle 200. Receptacle 200 can hold a medium sized ball as well as a variety of small objects (not shown) such as a poker chip, a coin, a dice, a card, etc.

Figure 5A:
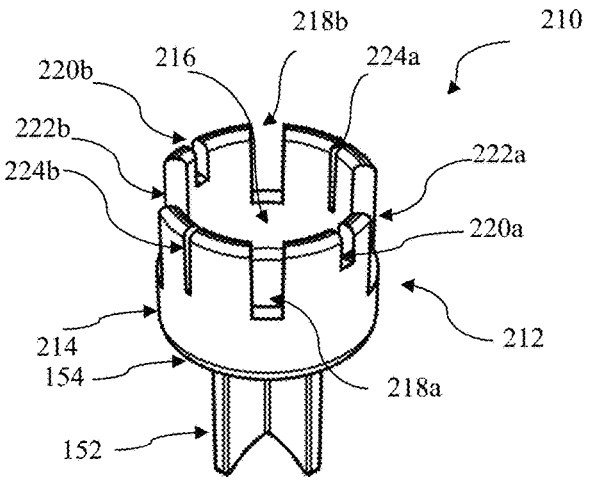
FIG. 5*a* is a schematic of a perspective view of a non-limiting example of a receptacle capable of being removably attached to the stem of the daisy support (not shown)
Figure 5B:
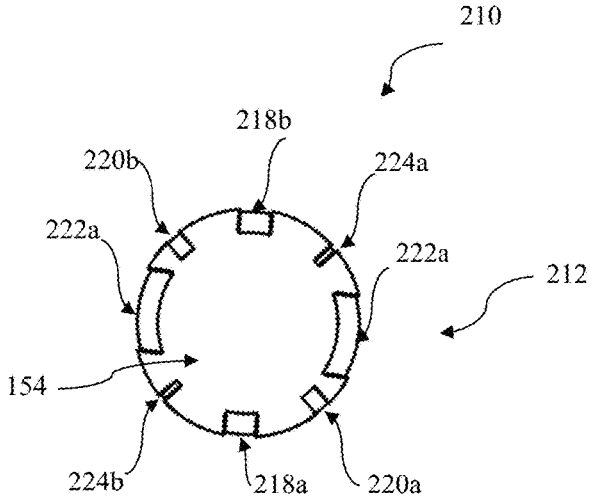
FIG. 5*b* is a schematic of a top view of the receptacle shown in FIG. 5*a;*
Figure 5C:
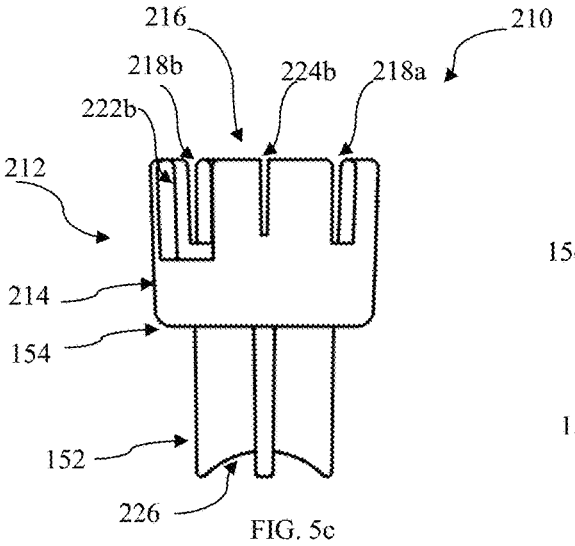
FIG. 5*c* a schematic of is a side view of the receptacle shown in FIG. 5*a;*
Figure 5D:
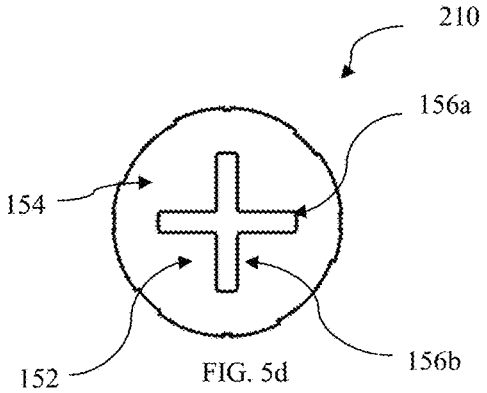
FIG. 5*d* is a schematic of a bottom view of the receptacle shown in FIG. 5*a;*
Figure 6A:
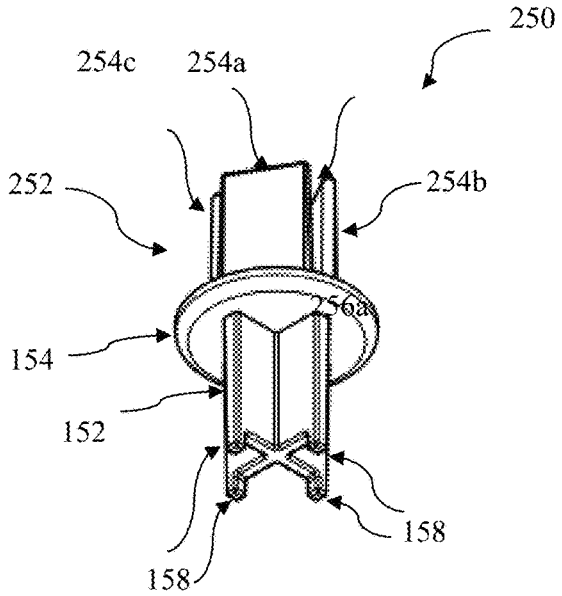
FIG. 6*a* is a schematic of a perspective view of a non-limiting example of a receptacle capable of being removably attached to the stem of the daisy support (not shown)
Figure 6B:
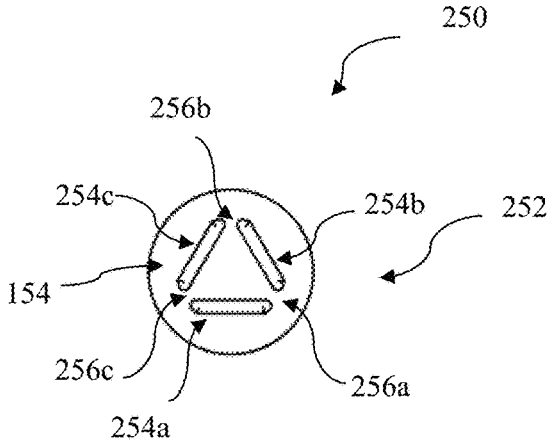
FIG. 6*b* is a schematic of a top view of the receptacle shown in FIG. 6*a;*
Figure 6C:
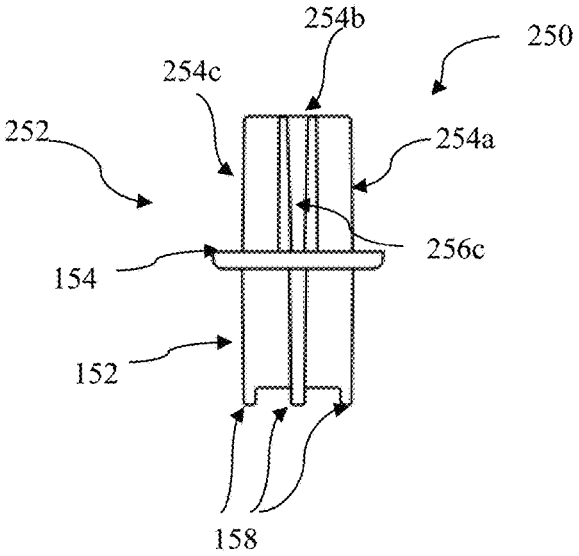
FIG. 6*c* is a schematic of a side view of the receptacle shown in FIG. 6*a;*
Figure 6D:
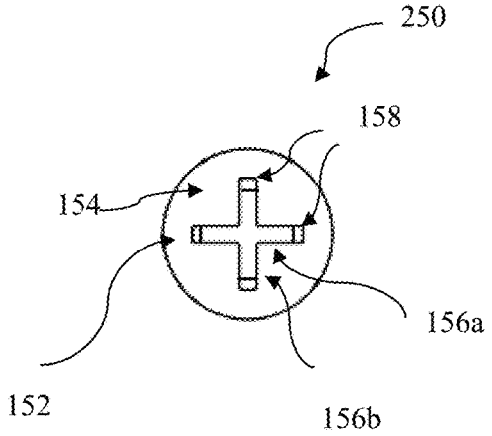
FIG. 6*d* is a schematic of a bottom view of the receptacle shown in FIG. 6*a;*

FIGS. 5*a*-5*d* are perspective, top, side, and bottom views, respectively, of a non-limiting embodiment of a receptacle 210. As shown in FIGS. 5*a*-5*d*, receptacle 210 has an attachment section 152, a transition section 154 and the object holding section 212. The object holding section 212 is a cylinder which includes the sidewall 214 and the transition section 154 distal to the attachment section 152. The object holding section 212 has an open top 216 through which objects (not shown) can be placed in receptacle 210. Object holding section 212 has differently sized (length and/or width) pairs of slits, 218*a,b*; 220*a,b*; 222*a,b*; and 224*a,b*, that start at the open top 216 and are offset 180 degrees around the object holding section 212. A player can set an object (not shown), into the object holding section 212 as long as a first dimension is thin enough thin enough to fit within the slit and a second dimension is longer than the diameter of the object holding section 212. For example, an index card can be placed in any of the slits, 218*a,b*; 220*a,b*; 222*a,b*; and 224*a,b*. The receptacle 210 has been described using the nomenclature for its different sections for the sicario where receptacle 210, as drawn, is placed into the stem (not shown). Receptacle 210 is capable of being a reversible receptacle. If receptacle 210 is turned upside down relative to FIG. 5*a*, the object holding section 212 serves the purpose of attachment section 152 previously described, except that object holding section 212 overlaps with the stem top 16 with the sidewall 214 on the outside of the stem 104. The attachment section 152 serves the purpose of the object holding section 212 previously described. The curvature 226 along the bottom (as shown in FIG. 5*c*) of attachment section 152 allows a small ball (not shown) to be placed on it when in the upside down position.

FIGS. 6*a*-6*d* are perspective (from the bottom), top, side, and bottom views, respectively, of a non-limiting embodiment of a receptacle 250. As shown in FIGS. 6*a*-6*d*, receptacle 250 has an attachment section 152, a transition section 154 and an object holding section 252. The object holding section 252 is made up of three same-size cuboids 256*a*, 256*b*, and 256*c*. The thinnest side of the cuboids 256*a-c* are attached vertically to the transition section 154 distal to the attachment section 152. The three cuboids 256*a-c* are arranged in a triangle with spaces 256*a* between cuboids 254*a* and 254*b*, 256*b* between cuboids 254*b* and 254*c*, and 256*c* between cuboids 254*c* and 254*a*.

Receptacle 250 is capable of being a reversible receptacle. If receptacle 250 is turned upside down relative to FIG. 6*a*, the object holding section 252 serves the purpose of attachment section 152 previously described, as object holding section 252 fits inside of stem 104. The attachment section 152 serves the purpose of previously describe object holding section 252. Raised ends 158 are on the outside of each edge of 156*a* and 156*b* distal to the transition section 154. A dice can fit, with its base enclosed by the raised ends 158, onto the distal ends of 156*a* and 156*b*.

Figure 7A:
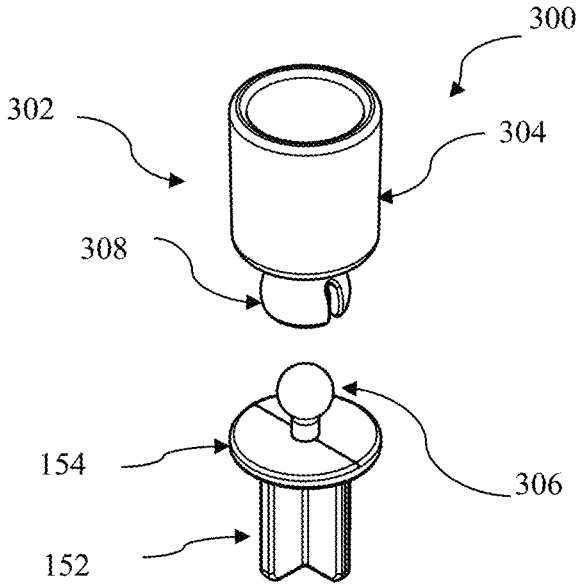
FIG. 7*a* is a schematic of a perspective view of a non-limiting example of a two-piece receptacle capable of being removably attached to the stem of the daisy support (not shown)
Figure 7B:
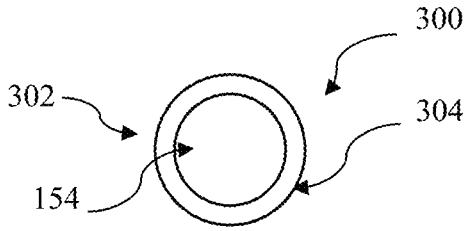
FIG. 7*b* is a schematic of a top view of the receptacle shown in FIG. 7*a;*
Figure 7C:
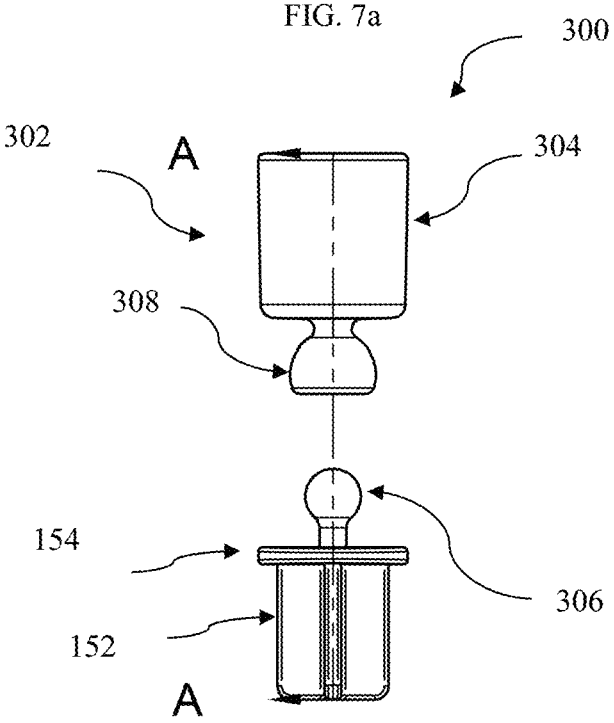
FIG. 7*c* is a schematic of a side view of the receptacle shown in FIG. 7*a;*
Figure 7D:
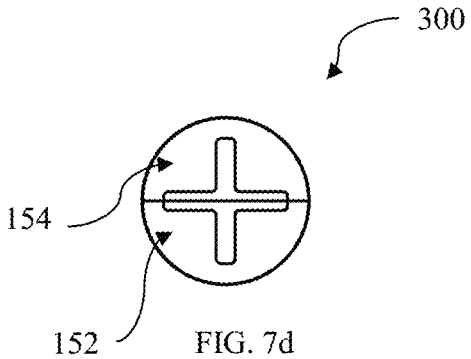
FIG. 7*d* is a schematic of a bottom view of the receptacle shown in FIG. 7*a;*
Figure 7E:
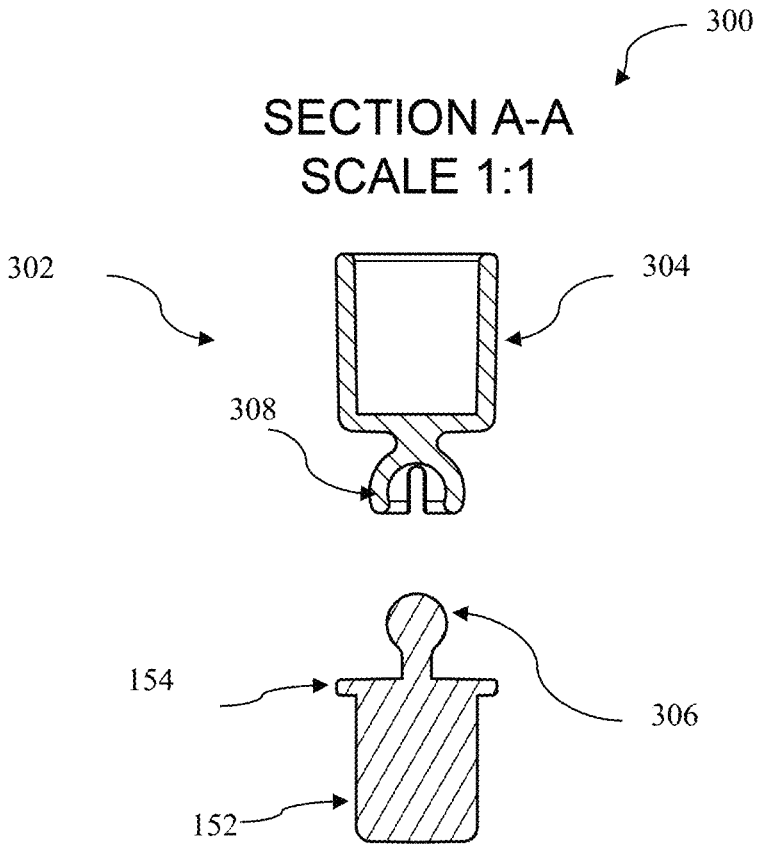
FIG. 7*e* is a schematic of a sectional view along A-A of the receptacle shown in FIG. 7*c.*
Figure 8A:
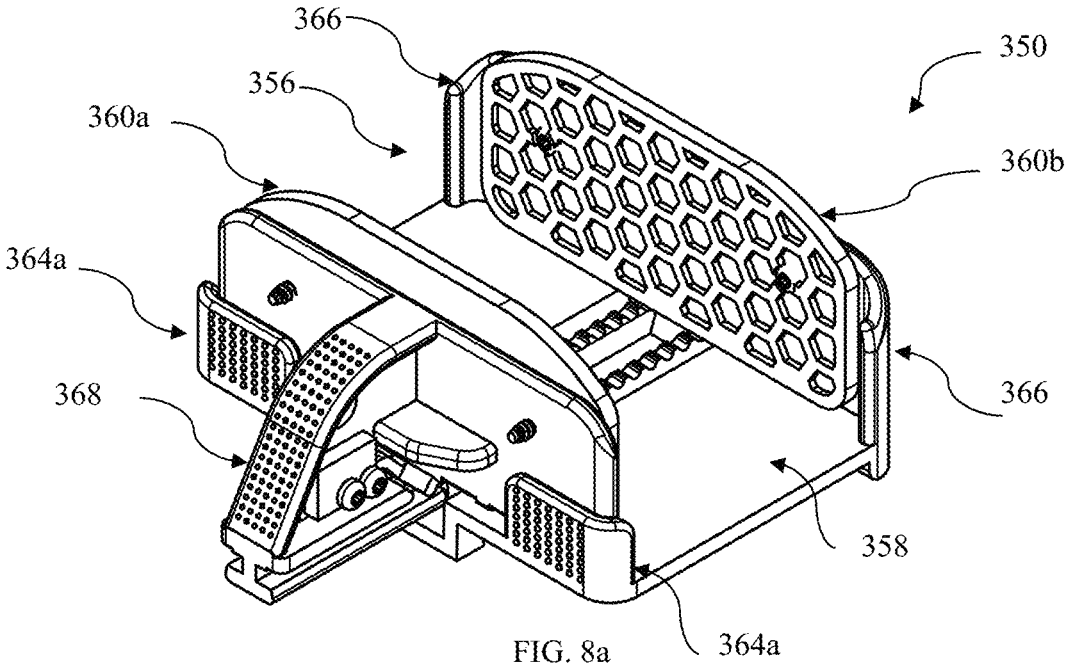
FIG. 8*a* is a schematic of a perspective view of a non-limiting example of an adjustable receptacle capable of being removably attached to the stem of the daisy support (not shown)
Figure 8B:
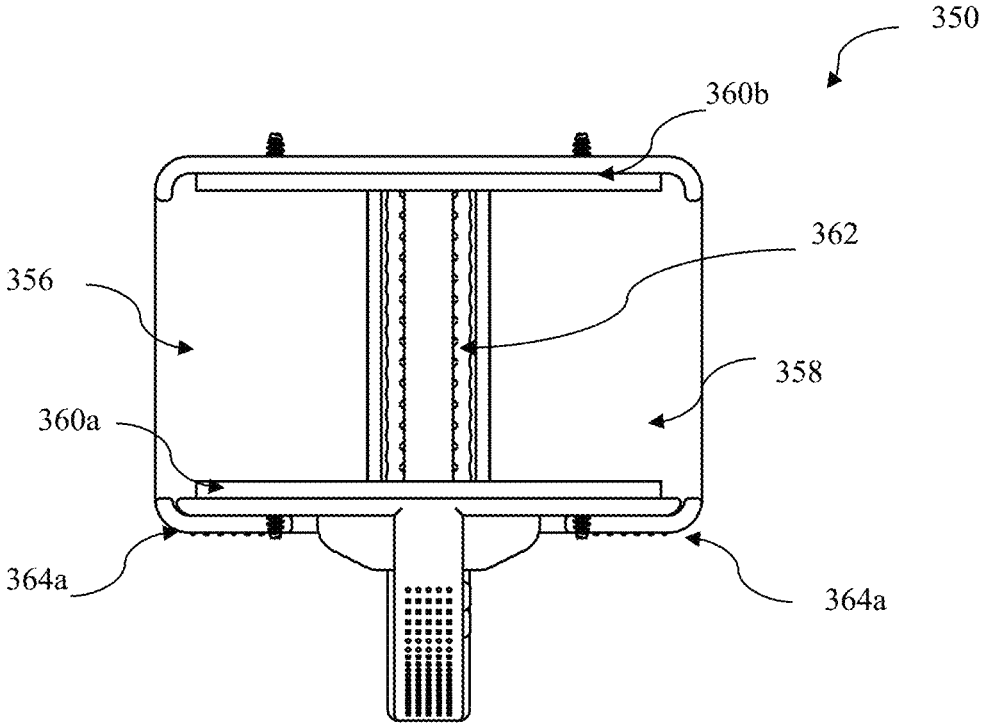
FIG. 8*b* is a schematic of a top view of the receptacle shown in FIG. 8*a;*
Figure 8C:
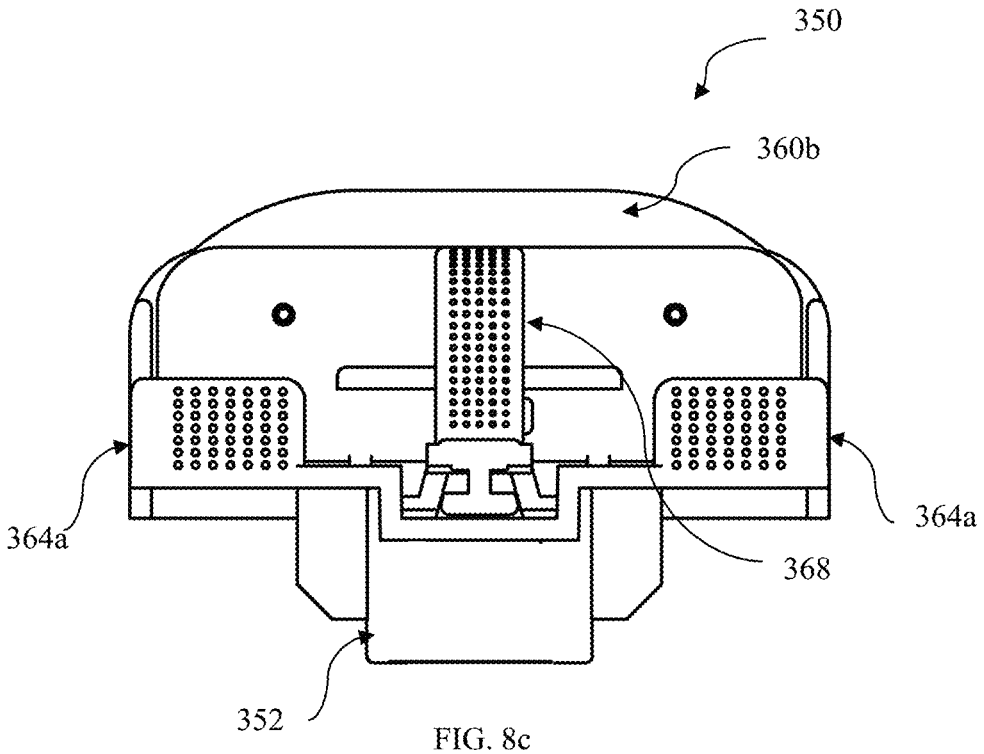
FIG. 8*c* is a schematic of a side view of the receptacle shown in FIG. 8*a;*
Figure 8D:
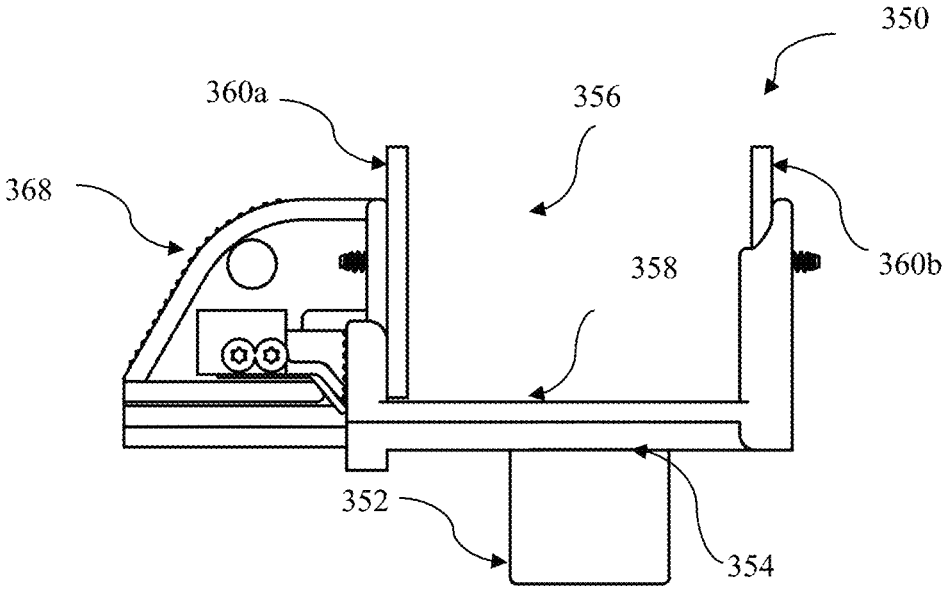
FIG. 8*d* is a schematic of a side view with the receptacle shown in FIG. 8*c*, turned 90 degrees.

FIGS. 7*a*-7*d* are perspective, top, side, and bottom, views, respectively, of a non-limiting embodiment of a receptacle 300. FIG. 7*e* is a section view of FIG. 7*c* along line A-A. As shown in FIGS. 7*a*-7*c*, receptacle 300 has an attachment section 152, a transition section 154, and an object holding section 302. Object holding section 302 comprises open cylinder 304 and mating component 306 attached at the closed end of open cylinder 304. Mating section 308 is attached to the transition section 154 distal to the attachment section 152. The transition section 154 and the holding section 302 are removably attachable via the mating of mating components 304 and 306.

FIGS. 8*a-d* are perspective, top, a first side, and a second side turned 90 degrees views, respectively, of a non-limiting embodiment of a receptacle 350. As shown in FIGS. 8*a*-8*d*, receptacle 350 has an attachment section 352, a transition section 354, and an object holding section 356. The object holding section 356 is made up of the base 358 and two movable sides 360*a* and 360*b*. The two movable sides 360*a-b* are slidably connectable via friction track 362. Either of the two movable sides 360*a-b* can be made to slide along the friction track 362 by applying pressure. When the object holder 356 is most open, the two moveable sides 360*a,b* are the furthest apart from each other, and the movable side 360*a* is touching the guardrails 364*a* and 364*b* and the movable side 360*b* is touching the guardrail 366. A handle 368 can be used to slide movable side 360*a* along track 362. Alternatively, one or two hands (not shown) can be used to slide either of the movable sides 360*a,b* along track 362.

Various receptacles that are removably attachable to the stem 104 at the stem top 106 are shown in FIGS. 3-8. Each receptacle 150, 200, 210, 250, and 300 in FIGS. 3-7 has an attachment section 152 that fits inside the stem opening 107, and a transition section 154. The non-limiting embodiments of the receptacles FIGS. 3-7 have a transition section which is permanently attached to the attachment section 152. In FIGS. 3-7, each receptacle 150, 200, 210, 250, and 300, has a different object holding section, 162, 202, 212, 252, and 302, respectively. When each receptacle 150, 200, 210, 250, and 300 is inserted into the stem opening 107, the attachment section 152 is located below the transition section 154, and the transition section is located below the object holding section 162, 202, 212, 252, and 302, respectively, and the object holding section 162, 202, 212, 252, and 302 is centered over the stem 104. The receptacle 350 in FIG. 8 has an attachment section 352 with a transition section 354, and the transition section 354 is permanently attached to the attachment section 352. When receptacle 350 is attached at the stem top 106, the attachment section 352 is located below the transition section 354, and the transition section is located below the object holding section 356.

Figure 9:
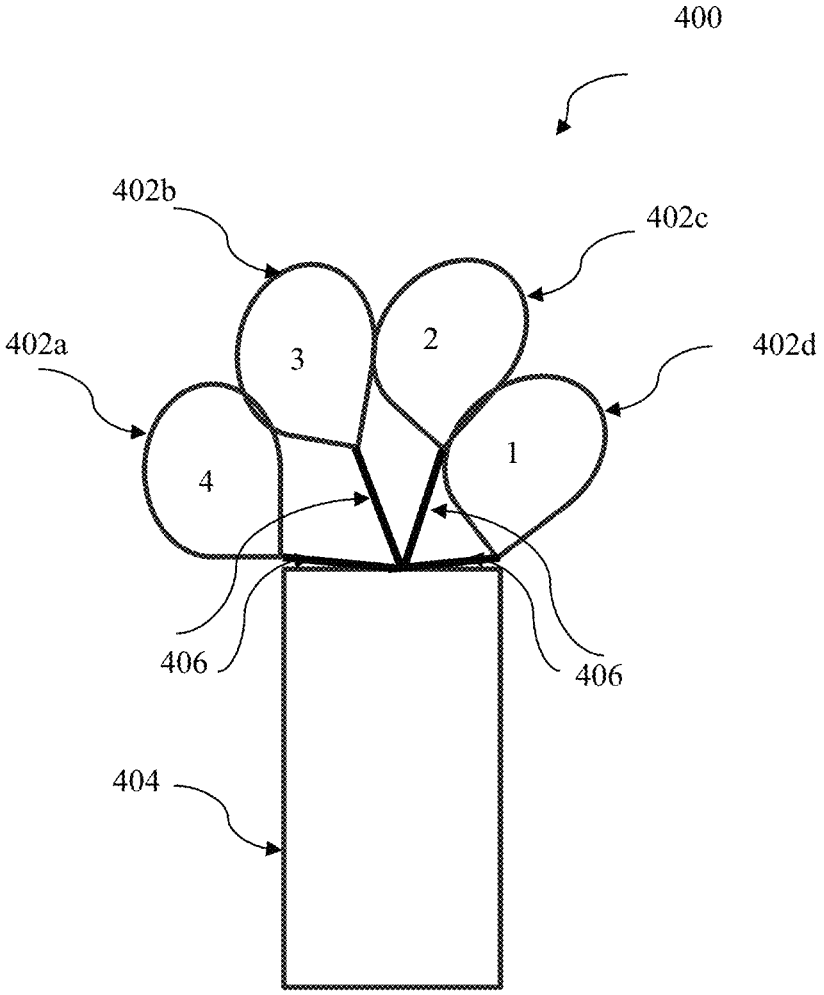
FIG. 9 is a schematic of a top view of a non-limiting embodiment of a score-keeping set of cards.

FIG. 9 is a top view of a non-limiting embodiment of a score-keeping set of card 400. The score-keeping set of cards 400 includes four balloon-shaped cards 402*a-d* labeled from 1 to 4 for the number of points earned. The cards are movably attached to a placard 404 at a single pivot point (not shown). The colorful droplets (not shown) can be placed on the card with the appropriate amount of points as the player (not shown) earns the points. At the end of the game, the player can use the number of colorful droplets on each of the cards 402*a-d* to tally a score. The cards 402*a-d* are stackable behind the placard when not in use.

Described below is a non-limiting embodiment of how a stroke survivor or other person might play the therapeutic game. The therapeutic game is designed to allow the player to play independently. The therapeutic game is designed so that the player can accomplish all tasks, including setting up the game, with the use of one hand. Although described below assuming the player is working independently, a therapist or other person may work with the player to set up the game and/or help in aspects of playing the game.

In order to set up the therapeutic game for playing, in some aspects, the player may first place the therapeutic game, the container with a closable lid and its contents, on a table. In some aspects, the player may unzip the lid of the container. In some aspects, the player may remove from the container a second, open-top container. In some aspects, the player may place the second, open-top container at some distance, perhaps 6 to 12 feet, from the container with the closable lid. In some aspects, the player may set up the daisy support with its base, stem, and the adjustable receptacle, as shown in FIG. 3*e*, and place it in the second, open-top container. The adjustable receptacle as shown in FIG. 3*e* is the most stable receptacle for most of the objects. In some aspects, the player may place some or all of the objects inside the second, open-top container. In some aspects, the player may fan the score-keeping set of colored cards (pedals) corresponding to the target openings on a table, place the corresponding set of colorful droplets on a table near its corresponding card, and unzip each container of colorful droplets. In some aspects, the player may fan the mistake set of cards (weeds) on a table, place the mistake set of droplets near the mistake set of cards, and unzip the container of the mistake set of droplet. In some aspects, the player may use a set of tallying cards. In some instances, the tallying cards can be written on with an erasable marker. In some aspects the tallying cards include four cards, one for Distance, one for Time, one for Point Tally, and one for Missed Objects. In some aspect, the tallying cards may include a "Distance" card on which the player may record the distance between the container with the closable lid and the second, open-top container, any difference in heights between the containers, and whether the player is sitting or standing. In some aspects, the tallying cards can include a "Time" card which the player can use to mark the start time and end time, as well as calculate the time taken (e.g., total playing time).

Once the therapeutic game is set up, a player may place an object on the daisy support with the adjustable receptacle. In some aspects, the player may choose to use their better functioning hand/arm to place an object into the adjustable receptacle. In some aspects, using the inferior functioning hand/arm, the player may attempt to remove the object from the adjustable receptacle, carry the object from the second, open-top container to the container with the closable lid, and place the object into one of the target openings. In some aspects, when the player is successful in completing this task, they will note the points scored by placing a color droplet on the color/number card corresponding to the target opening through which the object passed. In some aspects, there a four (4) target openings of different sizes and the point totals for each opening range from 1 to 4 and are inversely correlated to the size of the target opening (i.e., 1 point is allotted for the largest opening and 4 points are allotted for the smallest opening).

The game divides the "mistakes" that may keep the player from successfully moving an object from the dolly support and delivering the object through a target opening. First, the player may fail to successfully grasp the object off the dolly support and instead knock the object into the second, open-top container, or the player may drop the object once lifted off the dolly support into the second, open-top container. In some aspects, these mistakes result in the player placing a red droplet on the "Purple basket" weed. Second, the player may drop the object onto the table or floor between the two containers. In some aspects, this mistake results in the player placing a red droplet on the "Floor area" weed. Third, the player may get the object into the container with the closable lid, but not make the object pass through one of the target openings (i.e., the object passes through the auxiliary opening). In some aspects, this mistake results in the player placing a red droplet in the "hoops" weed.

In some aspects, the player repeats the attempts to move an object from the dolly support to and through a target opening based on the goal of interacting with a number of objects, based on a time duration goal, and/or based on stamina or interest.

Whereas the playing of the game is designed to challenge the players gross and fine motor skills, the scoring and any other documentation (e.g., a log, of the game) is designed to challenge the player's writing and cognitive skills. In some aspects, the player notes the end time and calculates the time taken (the time the player spent moving objects) on the Time tally card, In some aspects, the player counts the number of droplets on each of the cards corresponding to the targe openings, notes them on the Point Tally card, calculates the number of points for each of the target openings, and adds the total points for all objects passed through the target openings. In some aspects, the player counts the number of red droplets on each of the mistake cards and notes the number of missed objects that landed in the purple basket, the floor area, and the hoops on the Missed Objects tally card and adds the total number of missed objects. In some aspects, the Total Points for the game is the number of points earned by placing objects through the target openings minus the number of missed objects. In some aspects, the player keeps a log which may contain items such as the date, the total time, the point total for objects through the target openings, the point total for missed objects, the points per minute, the successful number of objects placed into a target opening divided by the number of missed objects, and/or etc. The log may be a source of encouragement as it helps the player see progress over time.

The playing of the therapeutic game described above was done with the fully opened adjustable receptacle as shown in FIG. 3*e*, as that is the most forgiving or stable receptacle as a player is trying to place an object in the object-holding section or remove an object from the object-holding section. As a player improves their skills, the adjustable receptacle can be partially closed as shown in FIG. 3*c*, or totally closed as shown in FIG. 3*a*. Also, each of the receptacles is capable of being removably attached to the stem of the daisy support, the player may choose to use any of the other receptacles included in the therapeutic game.

A non-limiting listing of embodiments follows.

A1. A therapeutic game comprising: a) a container with a closable lid; b) at least two target openings near the top of the container; and c) at least two objects, wherein each of the at least two objects can pass through at least one of the at least two target openings.

A2. The therapeutic game according to embodiment A1, wherein the therapeutic game further comprises: d) a score-keeping set of colorful droplets and cards.

A3. The therapeutic game according to any of embodiments A1 or A2, wherein the at least two target openings consist of two to four hoops, wherein each of the hoops is different in size; or wherein the at least two target openings are outlined within a ledge attached near the top of the container, and wherein each of the at least two target openings is different in size.

A4. The therapeutic game according to any of embodiments A1-A3, wherein the therapeutic game comprises 2 to 200 objects, and wherein the objects are selected from the group consisting of poker chips, small balls, tennis balls, racquet balls, dice, golf tees, playing cards, stoppers, and/or coasters; or wherein the therapeutic game comprises 2 to 200 objects, and wherein the at least two objects are in the form of geometric shapes selected from the group consisting of spheres, cubes, cuboidals, cones, cylinders, pyramids, prisms, and/or donuts.

A5. The therapeutic game according to any of embodiments A1-A4, wherein each of the at least two objects can pass through each of the at least two target openings.

A6. The therapeutic game according to any of embodiments A1-A5, wherein each of the at least two target openings has a different color marking and/or a different number marking.

A7. The therapeutic game according to any of embodiments A2-A6, wherein the score-keeping set of beads and cards comprises a set of colorful droplets corresponding to each of the at least two openings and a colored card corresponding to each set of the colorful droplets, wherein each of the colored cards has a different number, and wherein each set of colorful droplets comprises 2 to 100; or 2 to 75; or 2 to 50; or 5 to 100; or 5 to 75; or 5 to 50; or 10 to 100; or 10 to 75; or 10 to 50 colorful droplets.

A8. The therapeutic game according to embodiment A7, wherein the colored cards are connected in a fanned arrangement, wherein the colored cards can be laid out flat on a surface and the colorful droplets can be placed on the colored cards.

A9. The therapeutic game according to any of embodiments A7 or A8, wherein the score-keeping set of colorful droplets and cards further comprises a set of mistake colorful droplets and mistake cards, wherein each of the mistake cards is marked with a type of mistake, and wherein the mistake cards are connected in a fanned arrangement, and wherein the mistake cards can be laid out flat on a surface and the mistake colorful droplets can be placed on the mistake cards.

A10. The therapeutic game according to any of embodiments A1-A9, further comprising a daisy support, wherein the daisy support comprises a base, a stem attachable to the base, and at least one receptacle removably attachable to the stem distal from the base, wherein the receptacle is capable of intermittently holding up at least one of the at least two objects, and wherein the stem is attachable to the base either permanently or removably.

A11. The therapeutic game according to embodiment A10, wherein the at least one receptacle comprises: a) an attachment section capable of overlapping with the distal end of the stem when the at least one receptacle is removably attached to the stem; a transition section connected to the attachment section, wherein the transition section is not capable of overlapping with the distal end of the stem when the at least one receptacle is removably attached to the stem; and an object-holding section attached to the transition section on a side opposite to the attachment section, wherein the receptacle is capable of intermittently holding up at least one of the at least two objects placed on or in the object-holding section.

A12. The therapeutic game according to embodiment A11, wherein the attachment section fits inside the stem when the at least one receptacle is removably attached to the stem; or wherein the attachment section covers at least a part of the stem when the at least one receptacle is removably attached to the stem.

A13. The therapeutic game according to any of embodiments A10-A12, wherein each of the at least one receptacle is independently selected from the group consisting of adjustable receptacles, one-directional receptacles, or reversible receptacles A14. The therapeutic game according to embodiment A13, wherein the at least one receptacle comprises an adjustable receptacle, wherein the object-holding section comprises at least one moving part, wherein a size of the object-holding section can be varied.

A15. The therapeutic game according to embodiment A14, wherein the object-holding section comprises at least three flexible rods fixedly attached to the distal side of the transition section, and an adjustment section slidably attached to the at least three flexible rods, wherein the object holding section comprises an effective opening among the flexible rods, and wherein a size of the effective opening is adjustable from larger to smaller by moving the adjustment section further away from the transition section; or wherein the object-holding sections comprises a base and two sides, wherein at least one of the two sides is movable, and wherein the size of the object-holding section is varied by moving at least one of the two sides.

A16. The therapeutic game according to embodiment A15, wherein the adjustment section further comprises a second object-holding section on the side distal to the transition section, and wherein the second object-holding section is capable of intermittently holding at least one of the at least two objects.

A17. The therapeutic game according to any of embodiments A13-A16, wherein the at least one receptacle comprises a one-directional receptacle or a reversible receptacle, and wherein the object-holding section comprises a bowl, an open-top cylinder, at least three separated pieces, a three-dimensional X with a raised section at an end of the X distal to the transition section, or a three dimensional X with a curved shape of each line of the X distal to the transition section.

A18. The therapeutic game according to embodiment A17, wherein the object-holding section is the open cylinder having at least one pair of vertical slits starting at the top of the cylinder and located 180 degrees apart on the circumference, wherein each pair of slits is capable of holding up an index card; or wherein the object-holding section comprises at least three separated pieces and is capable of holding up an index card.

A19. The therapeutic game according to any of embodiments A17 or A18, wherein the at least one receptacle is the reversible receptacle, wherein the object-holding section is an open-top cylinder, and wherein when the reversible receptacle is placed up-side-down on the stem, the cylinder overlaps with the stem and covers the outside of the top of the stem when the receptacle is removably attached to the stem.

A20. The therapeutic game according to any of embodiments A17 or A18, wherein the at least one receptacle is the reversible receptacle, wherein the object-holding section is at least three separated pieces, a three-dimensional X with a raised section at an end of the X distal to the transition section, or a three dimensional with a curved shape of each line of the X distal to the transition section, and wherein when the reversible receptacle is placed up-side-down on the stem, the three separated pieces or any of the three dimensional X's fits within the stem when the receptacle is removably attached to the stem.

A21. The therapeutic game according to any of embodiments A1-A20, wherein the container further comprises an auxiliary opening, wherein the at least two objects are placeable within the container through the auxiliary opening.

A22. The therapeutic game according to any of embodiments A2-A21, wherein the score-keeping set of colorful droplets and cards are placeable within the container through the auxiliary opening.

A23. The therapeutic game according to any of embodiments A10-A22, wherein the daisy support, and the at least one receptacle are placeable within the container through the auxiliary opening.

A24. The therapeutic game according to any of embodiments A1-A23 wherein the therapeutic game weighs less than 50 pounds, less than 40 pounds, less than 30 pounds, less than 20 pounds, or less than 15 pounds.

B1. A therapeutic game comprising: a) a container with a closable lid; b) at least two objects; and c) a daisy support, wherein the daisy support comprises: i) a base; ii) a stem attachable to the base; and iii) an adjustable receptacle removable attachable to the stem distal from the base, wherein the at least one receptacle is capable of intermittently holding up at least one of the at least two objects, wherein the stem is attachable to the base either permanently or removably, wherein the adjustable receptacle comprises: a) an attachment section capable of overlapping with the distal end of the stem when the at least one receptacle is removably attached to the stem; b) a transition section connected to the attachment section, wherein the transition section is not capable of overlapping with the distal end of the stem when the at least one receptacle is removably attached to the stem; and c) an object-holding section attached to the transition section on a side opposite to the attachment section, wherein the object-holding section is adjustable, and the adjustable object-holding section comprises: i) at least three flexible rods fixedly attached to the distal side of the transition section; and ii) an adjustment section slidably attached to the at least three flexible rods, wherein the adjustable object-holding section comprises an effective opening among the flexible rods, and wherein a size of the effective opening is adjustable from larger to smaller by moving the adjustment section further away from the transition section.

B2. The therapeutic game according to embodiment B1, wherein the therapeutic game further comprises: d) at least two target openings near the top of the container, wherein each of the at least two objects can pass through at least one of the at least two target openings.

B3. The therapeutic game according to any of embodiments B1 or B2, wherein the therapeutic game further comprises: e) a score-keeping set of colorful droplets and cards.

B4. The therapeutic game according to any of embodiments B2 or B3, wherein the at least two target openings consist of two to four hoops, wherein each of the hoops is different in size; or wherein the at least two target openings are outlined within a ledge attached near the top of the container, wherein each of the at least two target openings is different in size.

B5. The therapeutic game according to any of embodiments B1-B4, wherein the therapeutic game comprises 2 to 200 objects, and wherein the objects are selected from the group consisting of poker chips, small balls, tennis balls, racquet balls, dice, golf tees, playing cards, stoppers, and/or coasters; or wherein the therapeutic game comprises 2 to 200 objects and wherein the at least two objects are in the form of geometric shapes selected from the group consisting of spheres, cubes, cuboidals, cones, cylinders, pyramids, prisms, and/or donuts.

B6. The therapeutic game according to any of embodiments B2-B5, wherein each of the at least two objects can pass through each of the at least two target openings B7. The therapeutic game according to any of embodiments B2-B6, wherein each of the at least two target openings has a different color marking and/or a different number marking.

B8. The therapeutic game according to any of embodiments B3-B7, wherein the score-keeping set of colorful droplets and cards comprises a set of colorful droplets corresponding to each of the at least two openings and a colored card corresponding to each set of the colorful droplets, wherein each of the colored cards has a different number, and wherein each set of colorful droplets comprises 2 to 100; or 2 to 75; or 2 to 50; 5 to 100; or 5 to 75; or 5 to 50; or 10 to 100; or 10 to 75; or 10 to 50 colorful droplets.

B9. The therapeutic game according to embodiment B8, wherein the colored cards are connected in a fanned arrangement, wherein the colored cards can be laid out flat on a surface and the colorful droplets can be placed on the colored cards.

B10. The therapeutic game according to any of embodiments B8 or B9, wherein the score-keeping set of colorful droplets and cards further comprises a set of mistake colorful droplets and mistake cards, wherein each of the mistake cards is marked with a type of mistake, and wherein the mistake cards are connected in a fanned arrangement, and wherein the mistake cards can be laid out flat on a surface and the mistake colorful droplets can be placed on the mistake cards.

B11. The therapeutic game according to any of embodiments B1-B10, wherein the adjustment section further comprises a second object-holding section on the side distal to the transition section, and wherein the second object-holding section is capable of intermittently holding at least one of the at least two objects B12. The therapeutic game according to any of embodiments B1-B11, wherein the therapeutic game further comprises at least one additional receptacle, wherein the at least one additional receptacle comprises: a) the attachment section capable of overlapping with the distal end of the stem when the at least one receptacle is removably attached to the stem; b) the transition section connected to the attachment section, wherein the transition section is not capable of overlapping with the distal end of the stem when the at least one receptacle is removably attached to the stem; and c) the object-holding section attached to the transition section on a side opposite to the attachment section.

B13. The therapeutic game according to embodiment B12, wherein the at least one additional receptacle comprises a one-directional receptacle or a reversible receptacle, and wherein the object-holding section comprises a bowl, an open-top cylinder, at least three separated pieces, a three-dimensional T with a raised section at an end of the T distal to the transition section, or a three dimensional T with a curved shape of each line of the T distal to the transition section.

B14. The therapeutic game according to embodiment B13, wherein the object-holding section is the open cylinder having at least one pair of vertical slits starting at the top of the cylinder and located 180 degrees apart on the circumference, wherein each pair of slits is capable of holding up an index card; or wherein the object-holding section comprises at least three separated pieces and is capable of holding up an index card B15. The therapeutic game according to any of embodiments B13 or B14, wherein the at least one receptacle is the reversible receptacle, wherein the object-holding section is an open-top cylinder, and wherein when the reversible receptacle is placed up-side-down on the stem, the cylinder overlaps with the stem and covers the outside of the top of the stem when the receptacle is removably attached to the stem.

B16. The therapeutic game according to any of embodiments B13 or B14, wherein the at least one receptacle is the reversible receptacle, wherein the object-holding section is at least three separated pieces, a three-dimensional X with a raised section at an end of the X distal to the transition section, or a three dimensional X with a curved shape of each line of the X distal to the transition section, and wherein when the reversible receptacle is placed up-side-down on the stem, the three separated pieces or any of the three dimensional X's fits within the stem when the receptacle is removably attached to the stem.

B17. The therapeutic game according to any of embodiments B2-B16, wherein the container further comprises an auxiliary opening, wherein the at least two objects are placeable within the container through the auxiliary opening.

B18. The therapeutic game according to any of embodiments B3-B17, wherein the score-keeping set of colorful droplets and cards are placeable within the container through the auxiliary opening.

B19. The therapeutic game according to any of embodiments B1-B17, wherein the daisy support, and the adjustable receptacle are placeable within the container through the auxiliary opening.

B20. The therapeutic game according to any of embodiments B1-B19, wherein the therapeutic game weighs less than 50 pounds, less than 40 pounds, less than 30 pounds, less than 20 pounds, or less than 15 pounds.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A therapeutic game comprising:

a) a container with a closable lid;

b) at least two target openings near the top of the container;

c) at least two objects; and d) a daisy support wherein each of the at least two objects can pass through at least one of the at least two target openings, wherein the daisy support comprises a base, a stem attachable to the base, and at least one receptacle removably attachable to the stem distal from the base, wherein the at least one receptacle is capable of intermittently holding up at least one of the at least two objects, and wherein the stem is attachable to the base either permanently or removably, wherein the at least one receptacle comprises i) an attachment section capable of overlapping with the distal end of the stem when the at least one receptacle is removably attached to the stem;

ii) a transition section permanently attached to the attachment section, wherein the transition section is not capable of overlapping with the distal end of the stem when the at least one receptacle is removably attached to the stem; and iii) an object-holding section attached to the transition section, wherein when the receptacle is removably attached to the stem, the attachment section is below the transition section, the transition section is below the object-holding section, and the object holding section is centered over the stem, and wherein the at least one receptacle is capable of intermittently holding up at least one of the at least two objects placed on or in the object-holding section.

2. The therapeutic game of claim 1 further comprising:

d) a score-keeping set of colorful droplets and cards.

3. The therapeutic game of claim 1, wherein the at least two target openings consist of two to four hoops, wherein each of the hoops is different in size.

4. The therapeutic game of claim 1, wherein the therapeutic game comprises 2 to 200 objects, and wherein the objects comprise poker chips, small balls, tennis balls, racquet balls, dice, golf tees, playing cards, index cards, stoppers, and/or coasters.

5. The therapeutic game of claim 2, wherein each of the at least two target openings has a different color marking and/or a different number marking, wherein the score-keeping set of colorful droplets and cards comprises a set of colorful droplets corresponding to each of the at least two target openings and a colored card corresponding to each set of the colorful droplets, wherein each of the colored cards has a different number, and wherein each set of colorful droplets comprises 2 to 100 colorful droplets.

6. The therapeutic game of claim 2, wherein the score-keeping set of colorful droplets and cards further comprises a set of mistake colorful droplets and mistake cards, wherein each of the mistake cards is marked with a type of mistake.

7. The therapeutic game of claim 1, wherein each of the at least one receptacle is independently selected from the group consisting of adjustable receptacles, one-directional receptacles, or reversible receptacles.

8. The therapeutic game of claim 7, wherein the at least one receptacle is the adjustable receptacle, wherein the object-holding section comprises at least three flexible rods fixedly attached to the distal side of the transition section, and an adjustment section slidably attached to the at least three flexible rods, wherein the object holding section comprises an effective opening among the flexible rods, and wherein a size of the effective opening is adjustable from larger to smaller by moving the adjustment section further away from the transition section.

9. The therapeutic game of claim 7, wherein the at least one receptacle comprises the one-directional receptacle or the reversible receptacle, and wherein the object-holding section comprises a bowl, an open-top cylinder, at least three separated pieces, a three-dimensional X with a raised section at an end of each line of the X distal to the transition section, or a three dimensional X with a curved shape of each line of the X distal to the transition section.

10. The therapeutic game of claim 9, wherein the object-holding section is the open-top cylinder having at least one pair of vertical slits starting at the top of the cylinder and located 180 degrees apart on a circumference of the cylinder, wherein each pair of slits is capable of holding up an index card.

11. A therapeutic game comprising:

a) a container with a closable lid;

b) at least two objects; and c) a daisy support, wherein the daisy support comprises i) a base;

ii) a stem removably attachable to the base; and iii) at least one receptacle removably attachable to the stem distal from the base;

wherein the stem is attachable to the base either permanently or removably, wherein the at least one receptacle comprises:

a) an attachment section capable of overlapping with the distal end of the stem when the at least one receptacle is removably attached to the stem;

b) a transition section connected to the attachment section, wherein the transition section is not capable of overlapping with the distal end of the stem when the at least one receptacle is removably attached to the stem; and c) an object-holding section attached to the transition section on a side opposite to the attachment section, wherein the at least one receptacle is capable of intermittently holding up at least one of the at least two objects placed on or in the object-holding section, wherein the at least one receptacle comprises an adjustable receptacle, wherein the object-holding section is adjustable, and the adjustable object-holding section comprises:

i) at least three flexible rods fixedly attached to the distal side of the transition section; and ii) an adjustment section slidably attached to the at least three flexible rods, wherein the adjustable object-holding section comprises an effective opening among the flexible rods, and wherein a size of the effective opening is adjustable from larger to smaller by moving the adjustment section further away from the transition section.

12. The therapeutic game of claim 11, further comprising:

d) at least two target openings near the top of the container; and e) a score-keeping set of colorful droplets and cards, wherein each of the at least two objects can pass through at least one of the at least two target openings.

13. The therapeutic game of claim 12, wherein the at least two target openings consist of two to four hoops, wherein each of the hoops is different in size, wherein the at least two objects comprise 2 to 200 objects, and wherein the objects comprise poker chips, small balls, tennis balls, racquet balls, dice, golf tees, playing cards, index cards, stoppers, and/or coasters.

14. The therapeutic game of claim 11, wherein the at least one receptacle comprises at least two receptacles comprising the adjustable receptacle and at least one additional receptacle.

15. The therapeutic game of claim 14, wherein the at least one additional receptacle comprises a one-directional receptacle or a reversible receptacle, wherein the object-holding section of the at least one additional receptacle comprises a bowl, an open-top cylinder, at least three separated pieces, a three-dimensional X with a raised section at an end of each line of the X distal to the transition section, or a three dimensional X with a curved shape of each line of the X distal to the transition section.

16. The therapeutic game of claim 15, wherein the object-holding section is the open-top cylinder having at least one pair of vertical slits starting at the top of the cylinder and located 180 degrees apart on the circumference, and wherein each pair of slits is capable of holding up an index card.

17. The therapeutic game of claim 15, wherein the at least one additional receptacle is the reversible receptacle, wherein the object-holding section is at least three separated pieces, a three-dimensional X with a raised section at an end of each line of the X distal to the transition section, or a three dimensional X with a curved shape of each line of the X distal to the transition section, and wherein when the reversible receptacle is placed up-side-down on the stem, the three separated pieces or any of the three dimensional X's fit within the stem when the at least one additional receptacle is removably attached to the stem.

18. A therapeutic game comprising:

a) a container with a closable lid;

b) two to four target openings near the top of the container;

c) two to two hundred objects;

d) a score-keeping set of colorful droplets and cards;

e) a daisy support, wherein the daisy support comprises;

i) a base;

ii) a stem removably attachable to the base; and iii) an adjustable receptacle removably attachable to the stem distal from the base; and f) at least one additional receptacle removably attachable to the stem distal from the base wherein each of the adjustable receptacle and the at least one additional receptacle comprises:

a) an attachment section capable of overlapping with the distal end of the stem when the adjustable receptacle or the at least one additional receptacle is removably attached to the stem;

b) a transition section connected to the attachment section, wherein the transition section is not capable of overlapping with the distal end of the stem when the adjustable receptacle or the at least one additional receptacle is removably attached to the stem; and c) an object-holding section attached to the transition section on a side opposite to the attachment section, wherein each of the adjustable receptacle and the at least one additional receptacle is capable of intermittently holding up at least one of the objects placed on or in the object-holding section, wherein, the adjustable receptacle object-holding section comprises:

i) at least three flexible rods fixedly attached to the distal side of the transition section; and ii) an adjustment section slidably attached to the at least three flexible rods, wherein the adjustable receptable object-holding section comprises an effective opening among the flexible rods, and wherein a size of the effective opening is adjustable from larger to smaller by moving the adjustment section further away from the transition section, and wherein each of the objects can pass through at least one of the two to four target openings.

* * * * *